US006933514B2

(12) United States Patent
Rhodes

(10) Patent No.: US 6,933,514 B2
(45) Date of Patent: Aug. 23, 2005

(54) METHOD OF IRRADIATING ORGANIC MATERIALS

(75) Inventor: Chad Rhodes, Lake Villa, IL (US)

(73) Assignee: Steris Inc., Temecula, CA (US)

( * ) Notice: Subject to any disclaimer, the term of this patent is extended or adjusted under 35 U.S.C. 154(b) by 157 days.

(21) Appl. No.: 10/327,825

(22) Filed: Dec. 23, 2002

(65) Prior Publication Data

US 2004/0119027 A1 Jun. 24, 2004

(51) Int. Cl.[7] ..... G21G 5/00
(52) U.S. Cl. ..... 250/492.3; 250/492.1
(58) Field of Search ..... 250/492.3, 492.1

(56) References Cited

U.S. PATENT DOCUMENTS 4,755,686 A * 7/1988 Miyazaki et al. ..... 250/492.3
6,683,031 B1 * 1/2004 Tavares ..... 508/216

* cited by examiner

*Primary Examiner*—Kiet T. Nguyen
(74) *Attorney, Agent, or Firm*—Kusner & Jaffe; Michael A. Centanni

(57) ABSTRACT

A method of irradiating a fibrous organic material comprising the steps of:

conveying an organic material formed into a cord-like configuration between two spaced-apart support members; and supplying a charged particle beam to the organic material at a location between the support members.

19 Claims, 3 Drawing Sheets

METHOD OF IRRADIATING ORGANIC MATERIALS

FIELD OF THE INVENTION

The present invention relates to the art of irradiating materials, and more particularly, to a method of irradiating organic materials.

BACKGROUND OF THE INVENTION

It is known that the physical properties of a material may be altered by treating the material with electron (e-beam) radiation. Typically, a material is placed within a basket or container and is conveyed through a focused electron beam. It is known that certain organic, fibrous materials may be altered by treating the material with electron beam radiation. For example, irradiating cotton produces an irradiated cotton material that may be crushed or milled into an extremely fine powder that finds advantageous application in the cosmetic industry, as well as in the lubrication industry.

One problem of irradiating organic materials, such as cotton, in a basket or container is that the container, which is typically metal, is irradiated together with the material. As a result, the container is heated as the e-beam radiation impinges thereon. Excessive heating of the metal container may cause discoloration and scorching of the organic material that is in contact with the container. In some applications, particularly in cosmetics, discoloration of the cotton material is undesirable.

Another problem with irradiating material as described above is handling the irradiated material. For example, irradiated cotton loses much of its tensile strength is quite friable, i.e., easily pulverized or milled by mechanical handling. This loss of tensile strength makes physical handling of the irradiated cotton more difficult, as compared to ordinary cotton.

A still further problem of irradiating cotton or other fibrous materials is applying uniform and even doses of radiation to the material. When stacked or piled in a basket or container, the compactness, i.e., the density and thickness, of the material may vary, thus varying the amount of radiation absorbed by the material as it passes through the electron beam.

The present invention overcomes these and other problems and provides a method of irradiating organic materials, such as cotton, which method does not require a physical container for holding the material.

SUMMARY OF THE INVENTION

In accordance with a preferred embodiment of the present invention, there is provided a method of irradiating a fibrous organic material comprising the steps of:

conveying an organic material formed into a cord-like configuration between two spaced-apart support members; and supplying a charged particle beam to the organic material at a location between the support members.

An advantage of the present invention is a method of irradiating organic materials without the material being in physical contact with a container or basket.

Another advantage of the present invention is a method of irradiating an organic material in a manner wherein the organic material is less susceptible to burning caused by the organic material receiving, a high dose of radiation or by being in contact with a heated surface.

Another advantage of the present invention is a method of irradiating an organic material, wherein the organic material receives a desired dose of radiation in a plurality of small incremental amounts.

Another advantage of the present invention is a method of irradiating an organic material, wherein the organic material receives a more uniform dose of radiation.

A still further advantage of the present invention is a method of irradiating an organic material, wherein the organic material is more easily handled before and after irradiation.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

The present invention relates to a method of irradiating an organic material, including a natural, fibrous, organic material. The invention is particularly applicable to irradiating cotton, and will be described with particular reference thereto. However, those skilled in the art will appreciate that the present invention may also find advantageous application for irradiating other similar, organic materials, such as, by way of example and not limitation, wool, hemp, leather, hides, wood pulp, silk, flax, straw and kenaf.

Figure 1:
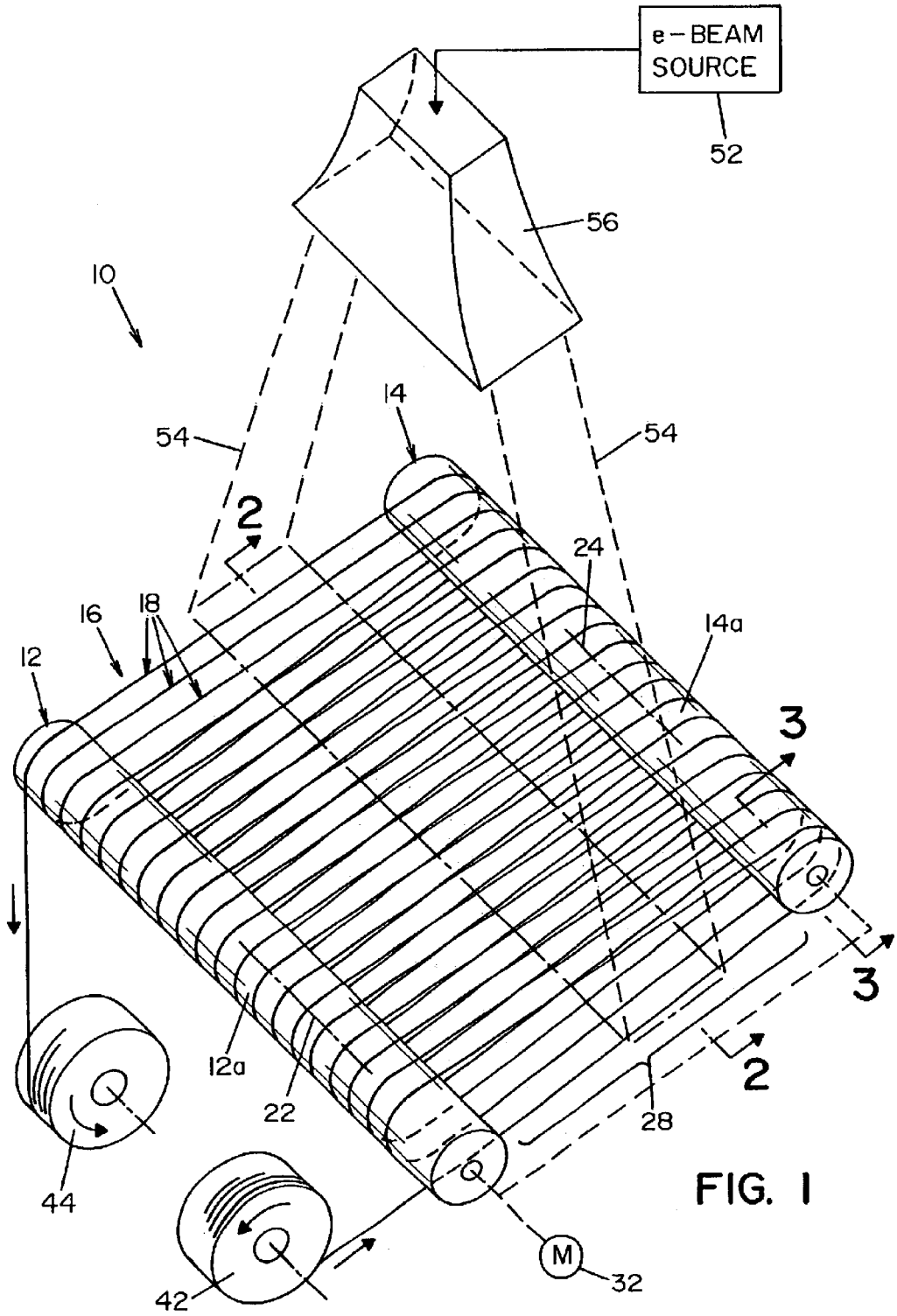
FIG. 1 is a perspective view of a process for irradiating an organic material, illustrating a preferred embodiment of the present invention.
Figure 3:
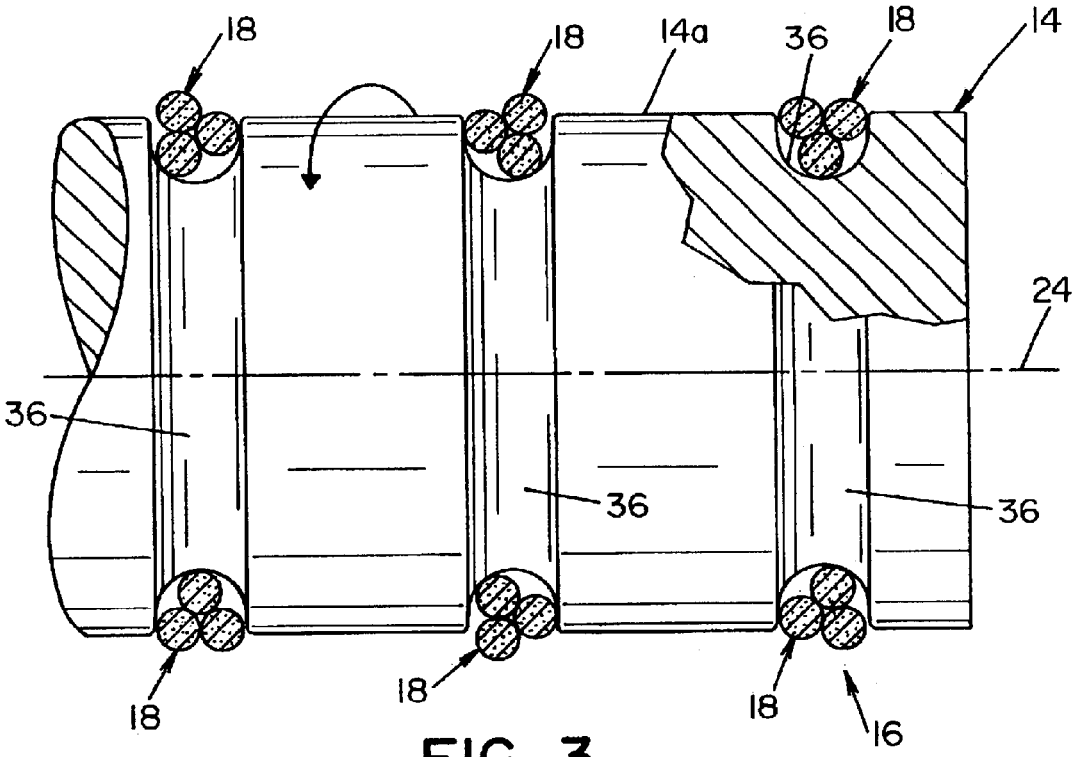
FIG. 3 is a sectional view taken along lines 3—3 of FIG. 1.

Referring now to the drawings wherein the showings are for the purpose of illustrating the preferred embodiment of the invention only, and not for the purpose of limiting same, FIG. 1 is a schematic view of a process for irradiating an organic material, such as cotton, illustrating a preferred embodiment of the present invention. Process 10 includes two (2) spaced-apart support members 12 and 14, between which an organic material 16 is to be conveyed. In the embodiment shown, support members 12, 14 are cylindrical rollers having outer cylindrical surfaces 12*a*, 14*a*, respectively. Rollers 12, 14 are aligned to be parallel to each other, and are rotatable about axis 22, 24, respectively. A space 28 is defined between rollers 12, 14. A motor assembly, schematically illustrated and designated 32 in the drawings, is provided to drive rollers 12, 14. Motor 32 is operable to simultaneously rotate rollers 12, 14 about axis 22, 24. Each roller 12, 14 has a plurality of spaced-apart annular grooves 36 formed therein, as best seen in FIG. 3.

Figure 4:
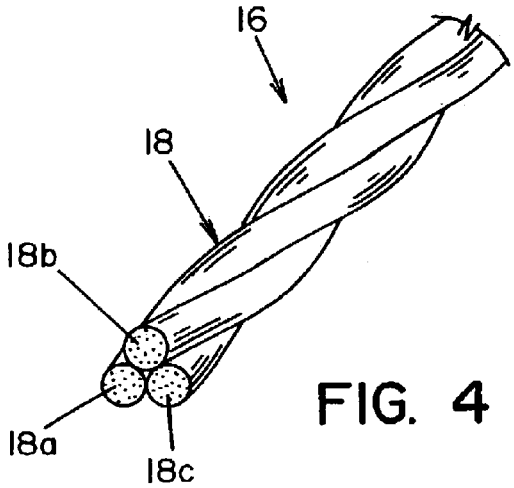
FIG. 4 is a perspective view of an organic material formed into a cord-like configuration for irradiation by the process shown in FIG. 1.

In accordance with one aspect of the present invention, organic material 16 is formed into a generally continuous, cord-like structure 18. As used herein, the term "cord-like"

is intended to define structures, such as cord, rope, string, twine, cable or the like, that may be formed from inner-twisting strands of organic material 16. Thin strips of a material may also find advantageous application in the present invention. FIG. 4 is a perspective view of organic material 16 formed into a cord or rope 18 that is formed from a plurality of twisted strands 18*a*, 18*b*, 18*c*, which are in turn comprised of a plurality of inner-twisted strands (not shown). Rope 18 of organic material 16 is conveyed between rollers 12, 14 across open space 28. In the embodiment shown, rope 18 is repeatedly wound around rollers 12, 14, wherein rope 18 spans space 28 several times. Cord or rope 18 of organic material 16 is disposed within annular grooves 36 to uniformly space cord 18 around rollers 12, 14 and in space 28.

In the embodiment shown, cord 18 is fed from a dispensing roll 42 and is collected onto a take-up roll 44. It will, of course, be appreciated that cord 18 may be dispensed in other ways, such as from a bin or from a cord processing line, and may be collected or taken-up by a process line or in a collection bin.

An accelerator 52, schematically illustrated in FIG. 1, generates an electron beam 54 that is scanned through a scan horn 56. Beam 54 of electrons, illustrated in phantom in FIG. 1, is disposed to pass through space 28 and to intersect cord 18 as it passes through space 28 between rollers 12, 14. E-beam 54 is preferably oriented to be perpendicular to cord 18 as it passes through space 28 between rollers 12, 14. However, e-beam 54 may intersect cord 18 at an angle without deviating from the present invention. In this respect, it is only desirable that e-beam 54 irradiates cord 18 only, and preferably not impinge upon rollers 12, 14.

Referring now to the operation of process 10, as shown in FIG. 1, cord 18 of organic material 16 from dispensing roll 42 is repeatedly wound around rollers 12, 14, with cord 18 being disposed in grooves 36. In the orientation shown, cord 18 first passes under roller 12, across space 28 and is wrapped around roller 14 to the top side thereof. Cord 18 is then passed back through space 28 to the top side of roller 12. Cord 18 is then wrapped around roller 12 to traverse space 28 back to roller 14. After its final pass over rollers 12, 14, cord 18 is wound onto take-up roll 44. Once cord 18 has been positioned on rollers 12, 14 and "threaded" onto take-up roll 44, motor 32 causes rollers to rotate simultaneously to convey cord 18 around rollers 12, 14 at a predetermined speed.

As cord 18 is conveyed from roller 12 to roller 14, it is conveyed through a first transfer plane to one side of rollers 12, 14 (i.e., through a plane below rollers 12, 14 in the orientation shown). As cord 18 is conveyed from roller 14 to roller 12, it is conveyed through a second transfer plane 64 on the other side of rollers 12, 14 (i.e., through a plane above rollers 12, 14 in the orientation shown). Transfer planes 62, 64 are shown in phantom in FIG. 2.

E-beam 54 is generated by accelerator 52 to irradiate cord 18. In process 10, the intensity and energy of e-beam 54 is preferably such that only a fraction of the total desired dose of radiation is applied to cord 18 during each pass between rollers 12, 14. The incremental amount of radiation to be applied during each pass through e-beam 54 is determined based upon the number of passes made by cord 18 through e-beam 54 and the total desired dose of radiation to be applied to cord 18. The specific dose of radiation to be applied to cord 18 will depend upon the organic material 16 to be irradiated and the resultant properties thereof.

Figure 2:
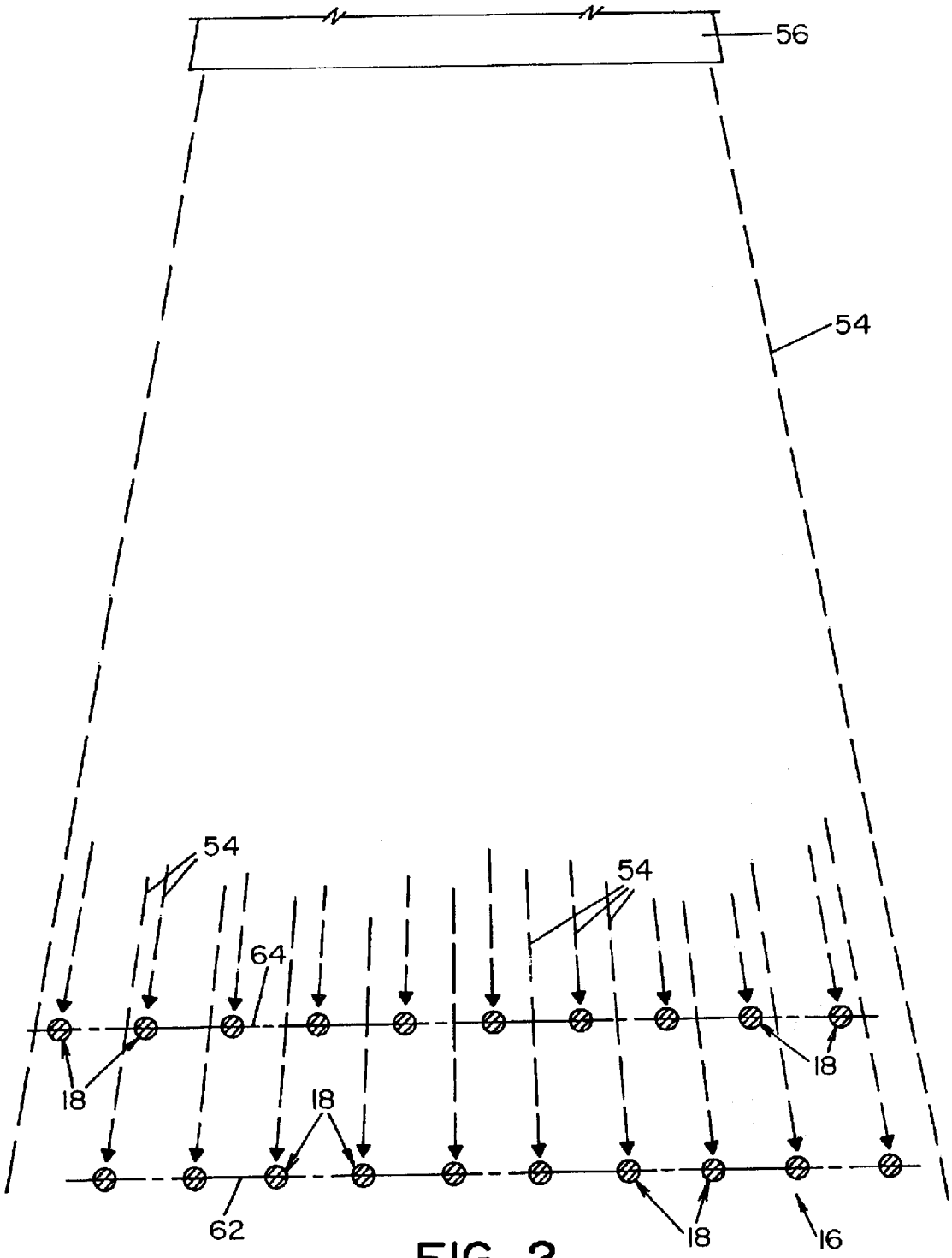
FIG. 2 is a sectional view taken along lines 2—2 of FIG. 1.

As best illustrated in FIG. 2, the spacing of cord 18 in second (upper) transfer plane 64 is such that radiation from e-beam 54 passes between cord 18 and impinges upon cord 18 in first (lower) transfer plane 62. It should be pointed that as cord 18 passes from roller 12 to roller 14 in first (lower) transfer plane 62, e-beam 54 impinges upon one side of cord 18, as illustrated in FIG. 2. As cord 18 moves onto and through second (upper) transfer plane 64, the side of cord 18 that was originally facing downward away from e-beam 54 when cord 18 was in first transfer plane 62, now faces e-beam 54 when cord 18 passes through second transfer plane 64. In other words, as cord 18 is conveyed from roller 12 to roller 14 in plane 62, one side of the cord is irradiated, and as cord 18 is conveyed from roller 14 to roller 12 in plane 64, the other side of cord 18 is irradiated. Thus, a more uniform irradiation of organic material 16 occurs because both sides of cord 18 are exposed to the same radiation and the same number of incremental doses.

The present invention thus provides a method of irradiating an organic material 16, wherein material 16 is not in contact with a basket or container during the irradiation thereof, thereby eliminating the possibility of burning or discoloration of material 16 that may be caused by material 16 being in contact with a hot surface of a basket or container. Further, the repeated passes of material 16 through the charged particle field, i.e., e-beam 54, allows the radiation to be applied in lower, incremental doses, thereby reducing the likelihood of burning of material 16 due to excessive levels of radiation as well as allowing the use of lower levels of radiation during processing. Still further, the generally uniform, cross-sectional configuration of organic materials 16, when formed into a cord 18, allows for more accurate application of the radiation. This, together with the disclosed process allowing for irradiation of both sides of the product, provides a more accurate and a more uniform irradiation of the organic material 16. Even further, by providing the irradiated product in cord-like configuration, the irradiated material is provided to subsequent users in a form that facilitates further processing since the irradiated material has known mass and weight per unit length. This allows for easier, more accurate feeding of the irradiated material into a subsequent processing line.

The present invention shall now be further described by way of example, wherein cotton is processed according to the present invention.

EXAMPLE

A processed, pure cotton, i.e., cotton that has been cleaned and processed to remove cotton seeds, is formed into a ½" diameter rope. A cotton rope sold by Rocky Mount Cord Company, in Rocky Mount, N.C. under the trade designation Romoco is used. The cotton rope has an initial tensile strength of about 600 psi. The cotton rope is irradiated as described above by repeatedly conveying the rope through an e-beam around spaced-apart rollers. With each pass through the e-beam, the cotton rope receives an incremental dose of radiation from the e-beam. The cotton rope is repeatedly passed through the e-beam until it has received a total dose of radiation in the amount of 800 kGy (80 Mrads), receiving such dose in a plurality of smaller, incremental doses.

The irradiated cotton shows minimal discoloration, and the resultant rope has a tested tensile strength of about 100 psi. This tensile strength is sufficient to allow the irradiated cotton rope to be wound onto a roll for subsequent shipping and processing. The rope exhibits properties consistent with uniform irradiation and is easily milled into powder form.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A method of irradiating a fibrous organic material, comprising the steps of:

conveying an organic material formed into a cord-like configuration between two spaced-apart support members; and applying a charged particle beam to said organic material at a location between said support members.

2. A method of irradiating a fibrous organic material as defined in claim 1, wherein said support members are cylindrical rollers and said organic material is repeatedly wound around said spaced-apart rollers and is continuously conveyed therearound, wherein said organic material repeatedly passes through said beam.

3. A method of irradiating a fibrous organic material as defined in claim 2, wherein said organic material is formed into a generally continuous rope.

4. A method of irradiating a fibrous organic material as defined in claim 2, wherein said rollers include surface guide means to uniformly space lengths of said organic material as it proceeds around said rollers.

5. A method of irradiating a fibrous organic material as defined in claim 4, wherein said surface guide means are spaced-apart, annular grooves formed in the surface of cylindrical rollers.

6. A method of irradiating a fibrous organic material as defined in claim 5, wherein said spaced-apart cylindrical rollers are parallel to each other.

7. A method of irradiating a fibrous organic material as defined in claim 6, wherein said rollers are simultaneously driven to rotate together at the same speed.

8. A method of irradiating a fibrous organic material as defined in claim 2, wherein said rollers define a first product transfer plane on one side and a second product transfer plane on another side of said rollers, and said charged particle beam intersects said first and second product transfer planes.

9. A method of irradiating a fibrous organic material as defined in claim 8, wherein said beam of charged particles impinges on one side of said organic material when said organic material is in said first product transfer plane, and impinges on another side of said organic material when said organic material is in said second product transfer plane.

10. A method of irradiating a fibrous organic material as defined in claim 1, wherein a fraction of a total radiation dose for said organic material is received by said organic material as it passes said beam in one of first and second product transfer planes defined by said rollers, said charge particle beam intersecting said first and second product transfer planes.

11. A method of irradiating a fibrous organic material as defined in claim 1, wherein said charged particle beam is an electron beam.

12. A method of irradiating a fibrous organic material as defined in claim 1, wherein said organic material is a naturally occurring material selected from the group consisting of cotton, wool, hemp, leather, hides, wood pulp, silk, flax and straw.

13. A method of irradiating a fibrous organic material as defined in 12, wherein said organic material is cotton.

14. A method of forming a cotton powder, comprising the steps of:

irradiating a cotton rope with an electron beam; and crushing said irradiated cotton rope into a powder.

15. A method of irradiating a fibrous, naturally occurring, organic material, comprising the steps of:

forming a fibrous, naturally occurring, organic material into a cord-like structure;

conveying said cord-like structure between two spaced-apart support members; and applying a charged particle beam to said cord-like structure at a location between said support members.

16. A method of irradiating a fibrous, naturally occurring, organic material as defined in claim 15, wherein said support members are cylindrical rollers and said cord-like structure is repeatedly wound around said spaced-apart rollers and is continuously conveyed therearound, wherein said cord-like structure repeatedly passes through said beam.

17. A method of irradiating a fibrous, naturally occurring, organic material as defined in claim 16, wherein said organic material is a naturally occurring material selected from the group consisting of cotton, wool, hemp, leather, hides, wood pulp, silk, flax and straw.

18. A method of irradiating a fibrous, naturally occurring, organic material as defined in claim 17, wherein said organic material is cotton.

19. A method of irradiating a fibrous, naturally occurring, organic material as defined in claim 18, wherein said charged particle beam is an electron beam.

* * * * *